US008186958B2

(12) United States Patent
Lee et al.

(10) Patent No.: US 8,186,958 B2
(45) Date of Patent: May 29, 2012

(54) FAN

(75) Inventors: Jung Woo Lee, Seoul (KR); Dong Soo Moon, Seoul (KR); Seok Ho Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 1186 days.

(21) Appl. No.: 11/965,822

(22) Filed: Dec. 28, 2007

(65) Prior Publication Data

US 2008/0159865 A1 Jul. 3, 2008

(30) Foreign Application Priority Data

Dec. 29, 2006 (KR) ..... 10-2006-0138631

(51) Int. Cl.
*F04D 29/30* (2006.01)

(52) U.S. Cl. ..... 416/186 R; 416/228; 416/241 R; 416/223 B

(58) Field of Classification Search ..... 416/185, 416/186 R, 241 R, 223 B, 228
See application file for complete search history.

(56) References Cited

U.S. PATENT DOCUMENTS

| | | | | |
|---|---|---|---|---|
| 1,873,974 | A * | 8/1932 | Meyer | 416/186 R |
| 2,918,254 | A * | 12/1959 | Hausammann | 415/116 |
| 3,481,531 | A * | 12/1969 | MacArthur et al. | 416/203 |
| 4,465,433 | A * | 8/1984 | Bischoff | 416/223 A |
| 5,215,439 | A * | 6/1993 | Jansen et al. | 416/183 |
| 5,554,004 | A | 9/1996 | Stewart | |
| 7,163,374 | B2 | 1/2007 | Lee et al. | |
| 7,214,033 | B2 | 5/2007 | Lee et al. | |
| 2004/0081548 | A1 | 4/2004 | Zess et al. | |
| 2004/0101409 | A1 | 5/2004 | Jung et al. | |
| 2005/0053493 | A1 | 3/2005 | Chung et al. | |
| 2005/0281669 | A1 | 12/2005 | Sohn et al. | |

FOREIGN PATENT DOCUMENTS

| | | |
|---|---|---|
| DE | 1 058 200 | 5/1959 |
| EP | 1 712 737 A1 | 10/2006 |

* cited by examiner

*Primary Examiner* — Ninh H Nguyen
(74) *Attorney, Agent, or Firm* — Birch, Stewart, Kolasch & Birch, LLP

(57) ABSTRACT

A fan includes a main plate and at least one or more blades connected to the main plate. At least a portion of a boundary portion between the main plate and a pressure surface of the blade is provided as a curved boundary portion such that the blade and the main plate are connected to each other at a curvature.

17 Claims, 7 Drawing Sheets

FAN

CROSS REFERENCE TO RELATED APPLICATION

The present disclosure relates to subject matter contained in priority Korean Patent Application No. 2006-0138631, filed Dec. 29, 2006, which is herein expressly incorporated by reference in its entirety.

BACKGROUND OF THE INVENTION

1. Field of the Invention

The present invention relates to a fan which can reduce abnormal noise by making air flow smooth.

2. Description of Related Art

In general, fans are used for sending air using a rotational force of blades or rotors and are widely applied to refrigerators, air conditioners, cleaners and the like. In particular, fans are divided into an axial flow fan, a sirocco fan, a centrifugal fan including a turbo fan and the like, depending on the method of withdrawing and discharging air or the shapes thereof.

Among the fans, the centrifugal fan withdraws air from an axial direction of the fan and then radially discharges the withdrawn air through spaces between blades, that is, a side surface of the fan. Since air is naturally drawn into the fan and is then discharged, a duct is not needed. The centrifugal fan is frequently applied to ceiling-type air conditioners having a relatively large size.

In the above-described conventional fan, however, when air flows from the inside to the outside of the blade, the air is not smoothly discharged and a vortex occurs, so that abnormal noise is generated.

SUMMARY OF THE INVENTION

The present invention has been provided to solve the problems of the related art, and an advantage of the present invention is that it provides a fan which can prevent abnormal noise by making air flow smooth.

According to an aspect of the invention, a fan includes a main plate and at least one or more blades connected to the main plate. At least a portion of a boundary portion between the main plate and a pressure surface of the blade is provided as a curved boundary portion such that the blade and the main plate are connected to each other at a curvature.

Preferably, the curved boundary portion is positioned at the upstream portion of the boundary portion in a flow direction.

Preferably, the curved boundary portion includes the entire e boundary portion in a flow direction.

Preferably, the curved boundary portion has a curvature of which at least a portion changes along a flow direction.

Preferably, a boundary line of the curved boundary portion at the main plate is nearly vertical with respect to an axial direction of the fan, and a boundary line of the curved boundary portion at the blade is varied in accordance with a curvature change with respect to the axial direction of the fan.

Preferably, the boundary line of the curved boundary portion at the blade has an inflected portion formed in a curved line.

Preferably, between the upstream point and the downstream point of the curved boundary portion, at least the curvature of the downstream point is substantially 0.

Preferably, the curvature of the curved boundary portion increases and then decreases along a flow direction.

Preferably, a boundary line of the curved boundary portion at the main plate is nearly vertical with respect to an axial direction of the fan, and a boundary line of the curved boundary portion at the blade includes a boundary-rising portion which is tilted toward the blade with respect to the axial direction of the fan and a boundary-dropping portion which is tilted toward the main plate with respect to the axial direction.

Preferably, in the curved boundary portion, a boundary portion between the boundary-rising portion and the boundary-dropping portion is formed in a curved line.

Preferably, between the upstream point and the upstream point of the curved boundary portion, at least the curvature of the downstream point is substantially 0.

According to another aspect of the invention, a fan includes a main plate and at least one or more blades connected to the main plate. A boundary portion between the main plate and a pressure surface of the blade is configured such that the blade and the main plate are connected to each other at a curvature. Further, a boundary line of the boundary portion at the blade includes a boundary-rising portion, which is tilted toward the blade with respect to an axial direction of the fan along a flow direction, and a boundary-dropping portion which extends from the boundary-rising portion and is tilted toward the main plate with respect to the axial direction along the flow direction.

Preferably, the boundary portion has the maximum curvature at a boundary point between the boundary-rising portion and the boundary-dropping portion.

Preferably, the curvature of the boundary-rising portion gradually increases along the flow direction.

Preferably, the curvature of the boundary-dropping portion gradually decreases along the flow direction.

Preferably, between the upstream point and the downstream point of the boundary portion, at least the curvature of the downstream point is substantially 0 along the flow direction.

Preferably, when the upstream point of the boundary portion is 0 and the upstream point of the boundary portion is 1 along the flow direction, a boundary point between the boundary-rising portion and the boundary-dropping portion is larger than 0 and is smaller than 0.5.

According to a further aspect of the invention, a fan includes a cover having a suction portion into which air is drawn; a main plate spaced from the cover along an axial direction; and a plurality of blades provided between the cover and the main plate in a radial shape such that air can be centrifugally discharged through the suction portion along an axis. At least a portion of a boundary portion between the main plate and a pressure surface of each blade is provided as a curved boundary portion such that the blade and the main plate are connected to each other at a curvature.

Preferably, between the upstream point and the downstream point of the curved boundary portion, at least the curvature of the downstream point is substantially 0 along a flow direction.

According to a still further aspect of the invention, a fan includes a cover having a suction portion into which air is drawn; a main plate spaced from the cover along an axial direction; and a plurality of blades provided between the cover and the main plate in a radial shape such that air can be centrifugally discharged through the suction portion along an axis. A boundary portion between the main plate and a pressure surface of the blade is configured such that the blade and the main plate are connected to each other at a curvature, and a boundary line of the boundary portion at the blade includes a boundary-rising portion, which is tilted toward the blade along a flow direction with respect to an axial direction of the fan, and a boundary-dropping portion which extends from the boundary-rising portion and is tilted toward the main plate along the flow direction with respect to the axial direction.

Preferably, between the upstream point and the downstream point of the curved boundary portion, at least the curvature of the downstream point is substantially 0 along the flow direction.

A further aspect of the present invention provides a method of discharging air through a fan including providing a fan including cover having a suction portion into which air is drawn; a main plate spaced from the cover along an axial direction; a plurality of blades provided between the cover and the main plate in a radial configuration such that air can be centrifugally discharged through the suction portion along an axis; and at least a portion of a boundary portion between the main plate and a pressure surface of each blade provided as a curved boundary portion such that the blade and the main plate are connected to each other at a curvature; and operating the fan including drawing air into the cover and centrifugally discharging air through the suction portion of the cover.

According to the invention, the fan constructed in such a manner includes the curved boundary portion provided at the boundary portion between the main plate and the pressure surface of the blade such that the main plate and the blade can be connected at a curvature. Air flow can be smoothly formed, without swirling or being congested. Therefore, abnormal noise can be prevented.

BRIEF DESCRIPTION OF THE DRAWINGS

The invention will be described with reference to the accompanying drawings, wherein like numbers reference like elements. The above, and other objects, features, and advantages of the present invention will be made apparent from the following description of the preferred embodiments, given as nonlimiting examples, with reference to the accompanying drawings in which.

DETAILED DESCRIPTION OF THE PREFERRED EMBODIMENT

Hereinafter, a fan according to the present invention will be described in detail with reference to the drawings. The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

The fan according to the invention can be implemented into a plurality of embodiments, and a preferred embodiment will be exemplified in the following descriptions.

Figure 1:
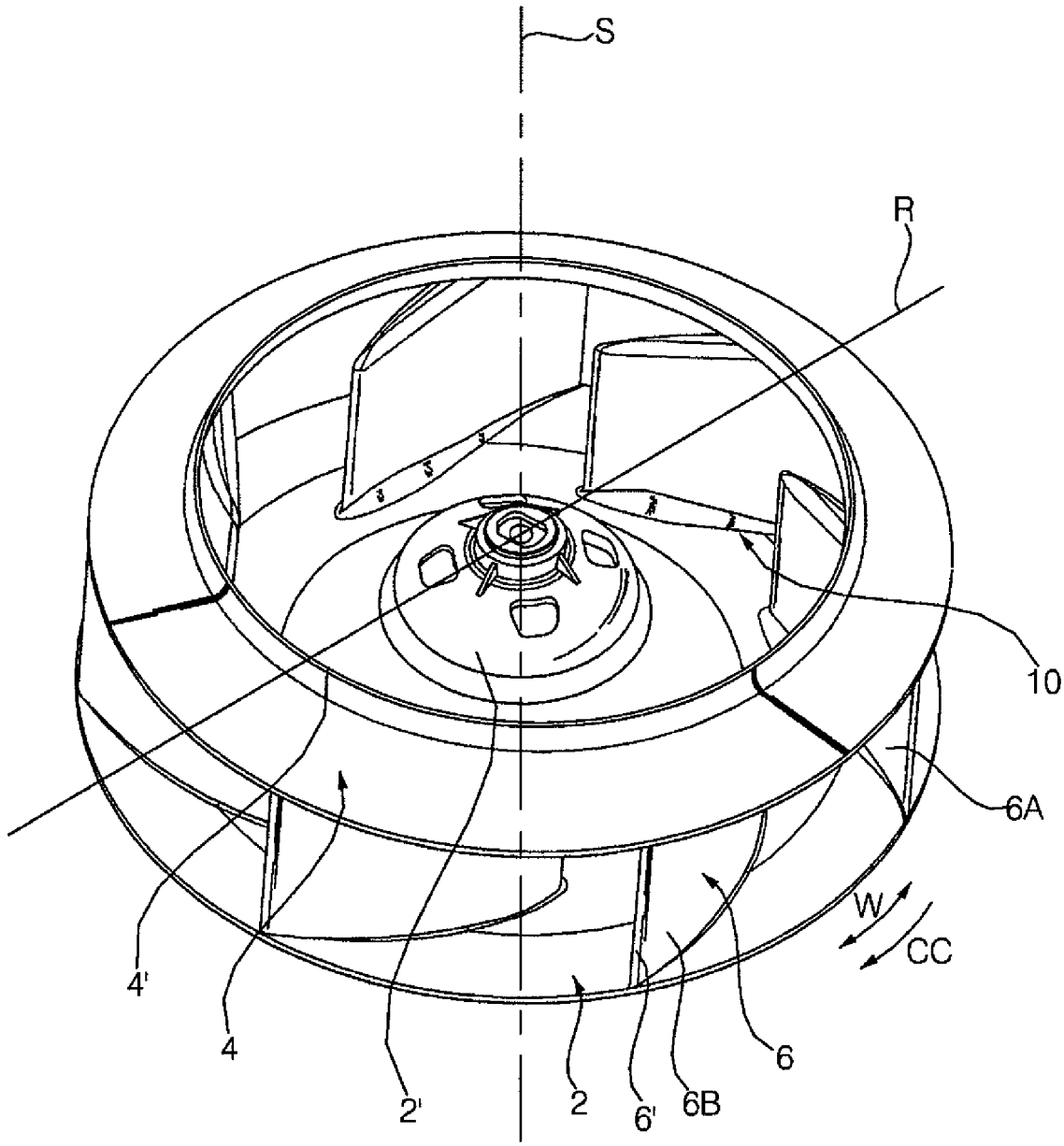
FIG. 1 is a perspective view of a fan according to an embodiment of the present invention.
Figure 2:
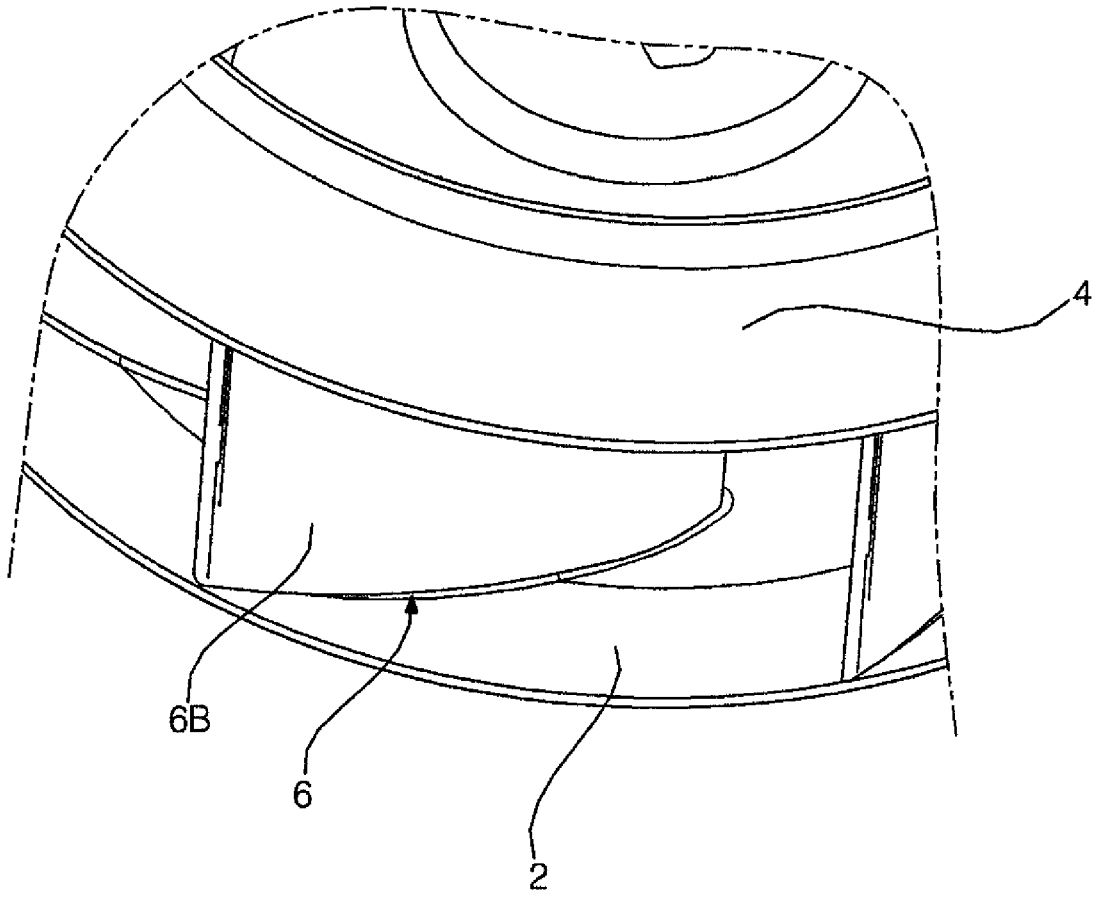
FIG. 2 is a partially-expanded perspective view of a suction surface of a blade of the fan shown in FIG. 1.
Figure 3:
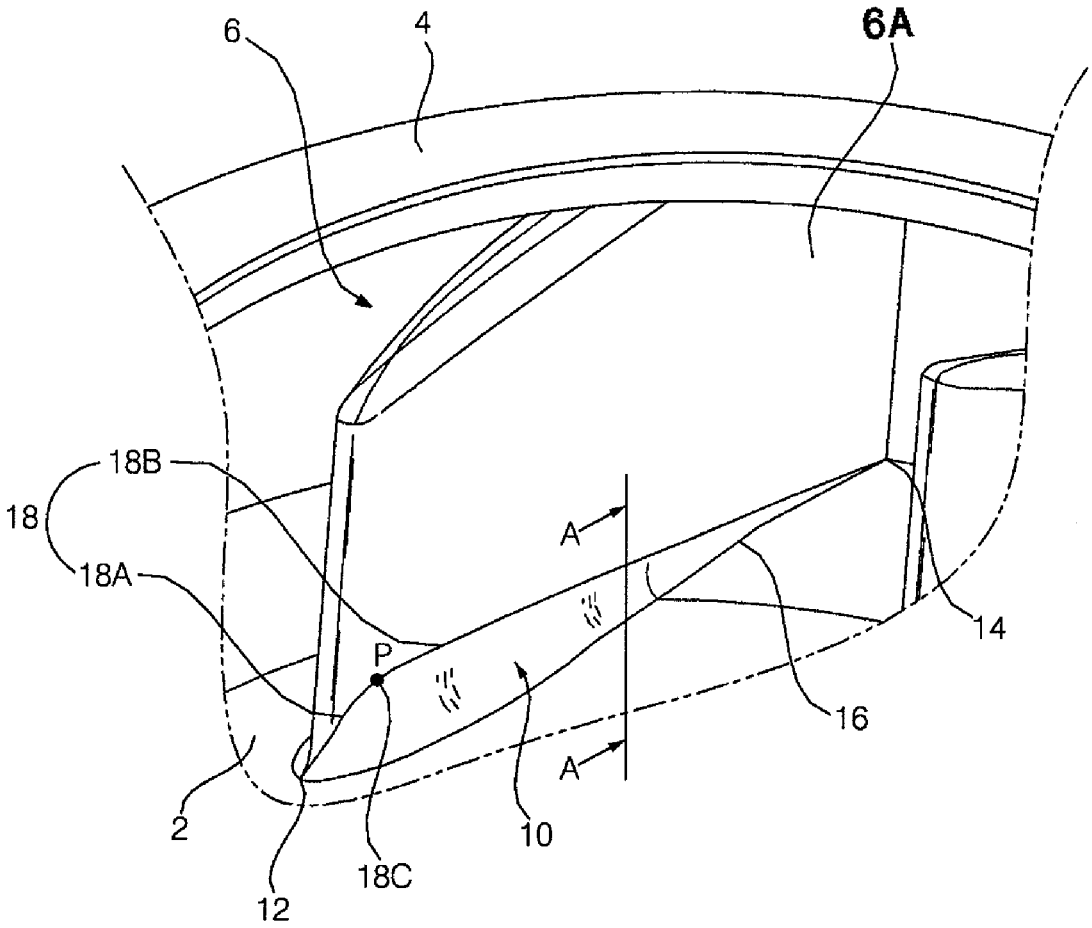
FIG. 3 is a partially-expanded perspective view of a pressure surface of a blade of the fan shown in FIG. 1.
Figure 4:
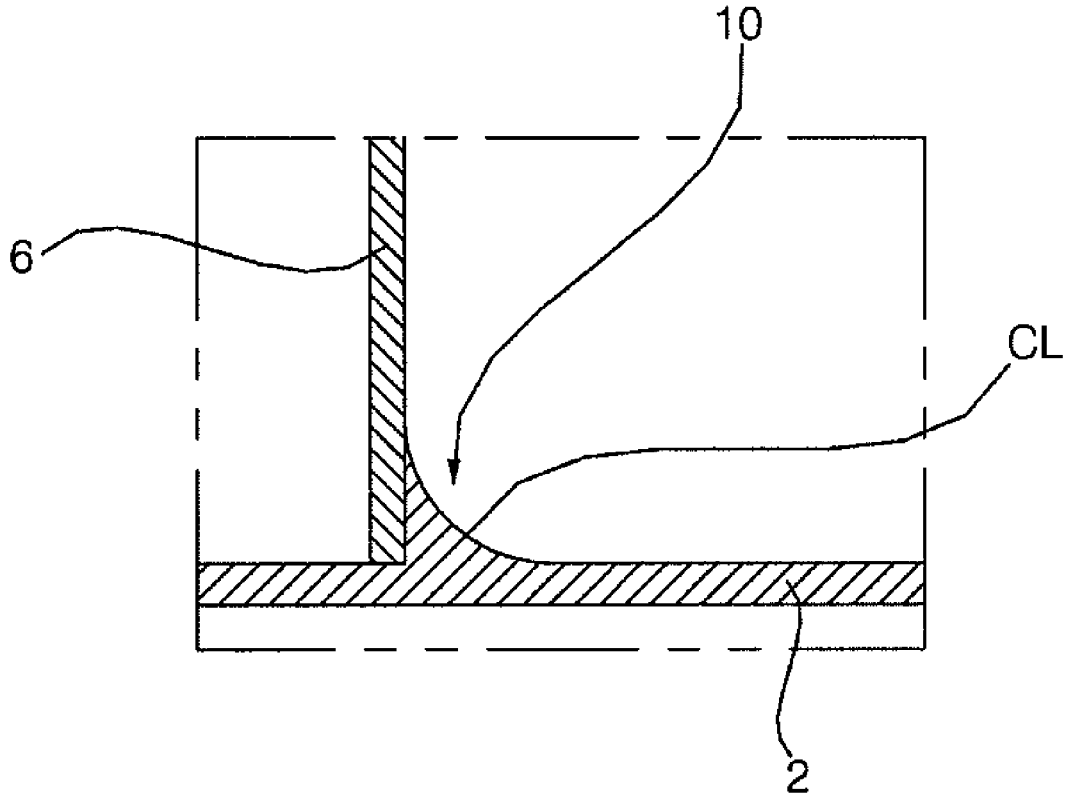
FIG. 4 is a cross-sectional view taken along line A-A of FIG. 3.

FIG. 1 is a perspective view of a fan according to an embodiment of the invention. FIG. 2 is a partially-expanded perspective view of a suction surface of a blade of the fan shown in FIG. 1. FIG. 3 is a partially-expanded perspective view of a pressure surface of a blade of the fan shown in FIG. 1. FIG. 4 is a cross-sectional view taken along line A-A of FIG. 3.

FIGS. 1 to 4 show a centrifugal fan, or specifically a turbo fan, among various types of fans. In the fan, air flow is drawn in an axial direction (indicated by an arrow S) of the fan, and the drawn flow is directed toward a radial direction (indicated by an arrow R) of the fan so as to be centrifugally discharged.

The fan according to this embodiment includes a main plate 2, a cover 4 spaced from the main plate 2 in the axial direction of the fan and having a withdrawing section 4' such that a flow can be drawn into a space between the main plate 2 and the cover 4, at least one or more blades 6 disposed between the cover 4 and the main plate 2, and a main body forming the exterior of the fan. The main body has an inlet, into which a flow is drawn, and an outlet from which a flow is discharged.

The main plate 2 may include a motor coupling portion 2' formed in the central portion thereof in the radial direction of the fan, the motor coupling portion 2' being coupled to a motor.

The cover 4 may be provided in a ring shape where the suction portion 4' is positioned in the center of the cover 4 in the radial direction of the fan.

The fan according to the invention may have one blade 6 or a plurality of blades 6. In this embodiment, a case where the fan has a plurality of blades 6 will be explained. The plurality of blades 6 can be arranged in a radial shape so as to be uniformly disposed in the circumferential direction (C) of the fan 2. In addition, the plurality of blades 6 can be arranged in various shapes depending on a flow characteristic. The plurality of blades 6 can be constructed in the same form as this embodiment. Alternately, the plurality of blades 6 can be constructed in a regular or irregular form depending on a flow characteristic. A tip 6' of each blade 6, positioned outside the fan in the radial direction of the fan, can coincide with the outer circumferential end of the main plate 2 in the radial direction of the fan. Alternately, the tip 6' of each blade 6 may be positioned more inwardly than the outer circumferential end of the main plate 2 in the radial direction of the fan or may project more outwardly than the main plate 2 in the radial direction of the fan.

Each of the blades 6 may have a vertically-projected surface formed in an aerofoil shape. The aerofoil shape is referred to as a streamlined shape developed by National Advisory Committee for Aeronautics (NACA) in 1950.

Each of the blades 6 may be inclined with respect to the radial direction of the fan, as in this embodiment. Alternately, each of the blades 6 may be disposed vertically with respect to the radial direction of the fan in accordance with a flow characteristic. Further, each of blades 6 may be formed in a curved shape in a rotational direction (indicated by an arrow CC) of the fan, as in this embodiment, or may be formed in a straight line.

Each of the blades 6 has a pressure surface 6A on which pressure according to a flow is applied and a suction surface 6B on which negative pressure is applied.

A boundary portion 10 between the pressure surface 6A of each blade 6 and the main plate 2 includes a curved boundary portion which will be described below. In this embodiment, the entire portion of the boundary portion 10 is constructed by the curved boundary portion, which means that the curved boundary portion can correspond to the boundary portion 10. Therefore, the curved boundary portion and the boundary portion 10 are represented by the same reference numeral in the following descriptions.

The curved boundary portion 10 serves to connect the pressure surface 6A of each blade 6 to the main plate 2 at a predetermined curvature such that a flow becomes smooth. The curvature means a curve CL represented in a vertical direction with respect to the main plate 2. The curved boundary portion 10 may form a portion or the entire portion of the boundary portion 10, depending on a flow characteristic. In particular, since a flow direction changes at the beginning or upstream portion of the boundary portion 10, the curved boundary portion 10 is constructed at least at the beginning portion of the boundary portion 10 along the flow direction. For reference, the beginning portion of the boundary portion 10 is referred to as a portion including a position where the boundary portion 10 originates along a flow direction, that is, a boundary beginning point 12. The end or downstream portion of the boundary portion 10 is referred to as a portion including a position where the boundary portion 10 is terminated along a flow direction, that is, a boundary end point 14. Hereinafter, the following descriptions will be limited to the case where the entire portion of the boundary portion 10 is constructed by the curved boundary portion, as described above.

The curved boundary portion 10 may have a constant curvature along a flow direction or a non-constant curvature along a flow direction as in this embodiment, depending on a flow characteristic. When the curved boundary portion 10 has a non-constant curvature along a flow direction as in this embodiment, only the curvature of a portion of the curved boundary portion 10 changes along the flow direction, and the curvature of the other portion of the curved boundary portion 10 may be constant. Alternately, the curvature of the entire boundary portion 10 may change, as in this embodiment.

Figure 7:
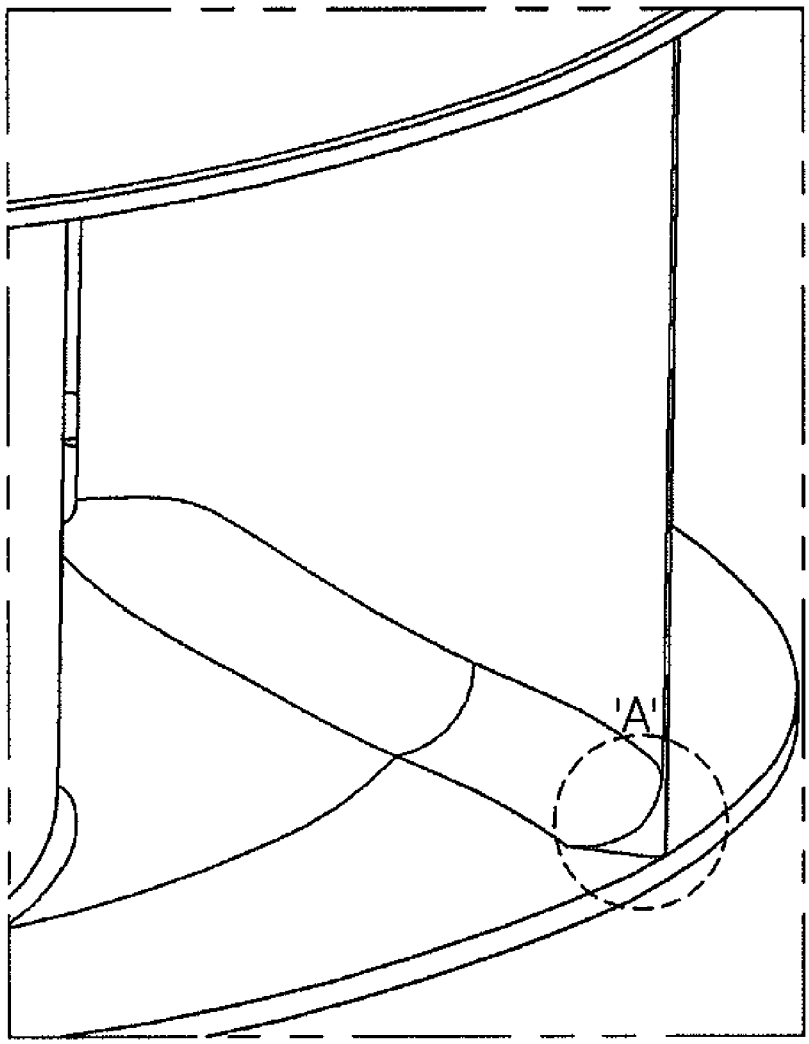
FIG. 7 is a partially-expanded perspective view of the structure of a fan according to another comparative example.

When the curved boundary portion 10 has a non-constant curvature, the curvature may change irregularly or may change regularly as in this embodiment. In particular, the curvature of the curved boundary portion 10 is set to increase and then decrease along a flow direction. Then, although the flow direction largely changes at the beginning portion of the boundary portion 10, a dead zone of flow can be eliminated when the curvature of the curved boundary portion 10 at the beginning portion of the boundary portion 10 is set to a large value. Further, when the curvature of the curved boundary portion 10 at the end portion of the boundary portion 10 is set to a small value such that a surface of discontinuity can be minimized at the end portion of the boundary portion 10, it is possible to prevent a vortex from occurring in the end portion of the boundary portion 10. For reference, the surface of discontinuity is referred to as a state where the end point 14 of the boundary portion 10 forms a surface, not a point, as indicated by 'A' in FIG. 7.

The curved boundary portion 10 may have a curvature which is not 0 or a curvature of substantially 0 at the point where the curved boundary portion 10 originates along a flow direction. For reference, since the curved boundary portion 10 corresponds to the boundary portion 10 in this embodiment, the beginning point of the curvature boundary portion 10 is substantially the same as the boundary beginning point 12. A point at which the curved boundary portion 10 is terminated is substantially the same as the boundary end point 14. Although the curved boundary portion 10 may have a curvature, which is not 0, at the boundary end point 14, it is preferable that the curvature is substantially 0 as in this embodiment. When the curvature at the end point 14 is 0, a surface of discontinuity is not formed, so that a flow can be smoothly formed.

A boundary line 16 of the curved boundary portion 10 at the main plate may be formed in a straight line nearly vertical with respect to the axial direction of the fan, regardless of a curvature change of the curved boundary portion 10 according to a flow direction. Further, the boundary line 16 of the curved boundary portion 10 at the main plate may be formed in another shape, not a straight line, along a curvature change of the curved boundary portion 10 according to a flow direction. In this case, when the boundary line 16 of the curved boundary portion 10 at the main plate has a bent portion, that is, an inflected portion, the inflected portion is constructed in a curved line such that a flow becomes smooth. A boundary line 18 of the curved boundary portion 10 at the blade is varied in accordance with a curvature change of the curved boundary portion 10 with respect to the axial direction of the fan.

In particular, as described above, the boundary line 18 of the curved boundary portion 10 at the blade may include a boundary-rising portion 18A, which is leaned toward the blade 6 with respect to the axial direction of the fan, and a boundary-dropping portion 18B which extends from the boundary-rising portion 18A in a flow direction and is leaned toward the main plate 2 such that the curvature of the curved boundary portion 10 increases and then decreases along the flow direction.

Further, as described above, the boundary-rising portion 18A is formed in such a manner that the curvature of the curved boundary portion 10 gradually increases along a flow direction, and the boundary-dropping portion 18B is formed in such a manner that the curvature of the curved boundary portion 10 gradually decreases along the flow direction. Then, the curvature of the curved boundary portion 10 increases and then decreases along the flow direction. In this case, the curved boundary portion 10 has the maximum curvature at a boundary point 18C between the boundary-rising portion 18A and the boundary-dropping portion 18B. For reference, the boundary-rising portion 18A is referred to as a portion where the boundary line 18 of the curved boundary portion 10 at the blade is leaned toward the blade 6 so as to rise in a vertical direction with respect to the main plate 2. Further, the boundary-dropping portion 18B is referred to as a portion where the boundary line 18 of the curved boundary portion 10 at the blade is leaned toward the main plate 2 so as to drop in a vertical direction with respect to the main plate 2.

The boundary point 18C between the boundary-rising portion 18A and the boundary-dropping portion 18B can be defined as a position of which the value is larger than 0 and is smaller than 0.5, when the boundary beginning point 12 is 0 and the boundary end point 14 is 1. Then, since the boundary-dropping portion 18B is constructed to extend along a flow direction, a flow can be gently formed.

A boundary portion 18' between the boundary-rising portion 18A and the boundary-dropping portion 18B, that is, an inflected portion includes the boundary point 18C between the boundary-rising portion 18A and the boundary-dropping portion 18B. The boundary portion 18' can be constructed in a curved line such that a flow direction can gently change.

The boundary-rising portion 18A and the boundary-dropping portion 18B may be formed in a curved line, a straight line, or a combination of curved line and straight line.

Meanwhile, in order to change the curvature of the boundary portion 10, that is, to provide the curved boundary portion 10, the shape of the main plate 2 or the blade 6 may be changed. The curved boundary portion 10 can be separately manufactured and then coupled.

Hereinafter, the operation and operational effect of the fan constructed in such a manner will be described.

When the fan is rotated by a driving force of the motor, a flow is drawn into the fan through the suction portion 4' of the cover 4 along the axial direction (indicated by the arrow S) of the fan, and the drawn flow is discharged while being directed to the radial direction (indicated by the arrow R) of the fan, or more specifically, the centrifugal direction of the fan.

In this case, since the curved boundary portion 10 is constructed at the beginning portion of the boundary portion 10, a dead zone where a flow swirls or is congested is not formed, even though a flow direction changes. Therefore, a flow can be smoothly formed.

Further, the curvature of the curved boundary portion 10 can be varied along a flow direction. Therefore, when the curvature of the curved boundary portion 10 increases and then decreases along the flow direction, a flow can be gently and smoothly formed in accordance with a flow characteristic.

Further, when the curved boundary portion 10 is constructed in the entire portion of the boundary portion 10, a flow to be discharged to the outside of the fan can be smoothly formed as a whole.

In addition, since at least the inflected portion of the curved boundary portion 10 is constructed in a curved line, a flow passing through the boundary portion 10 does not severely change. Therefore, a flow can be gently and smoothly formed.

Further, since the curvature of the curved boundary portion 10 is varied, a surface of discontinuity in the boundary portion 10 can be minimized so that an excellent flow characteristic is obtained. In particular, when the curvature of the boundary end point 14 of the curved boundary portion 10 is substantially 0, a surface of discontinuity in the boundary portion 10 is not present, so that a flow characteristic can be optimized.

In addition, since the boundary-dropping portion 18B of the curved boundary portion 10 is constructed to be longer than the boundary-rising portion 18A of the curved boundary portion 10, a flow can be more gently formed.

Therefore, when the fan is operated, a high-frequency bandwidth of abnormal noise, which jars on the ears, can be prevented.

Figure 5:
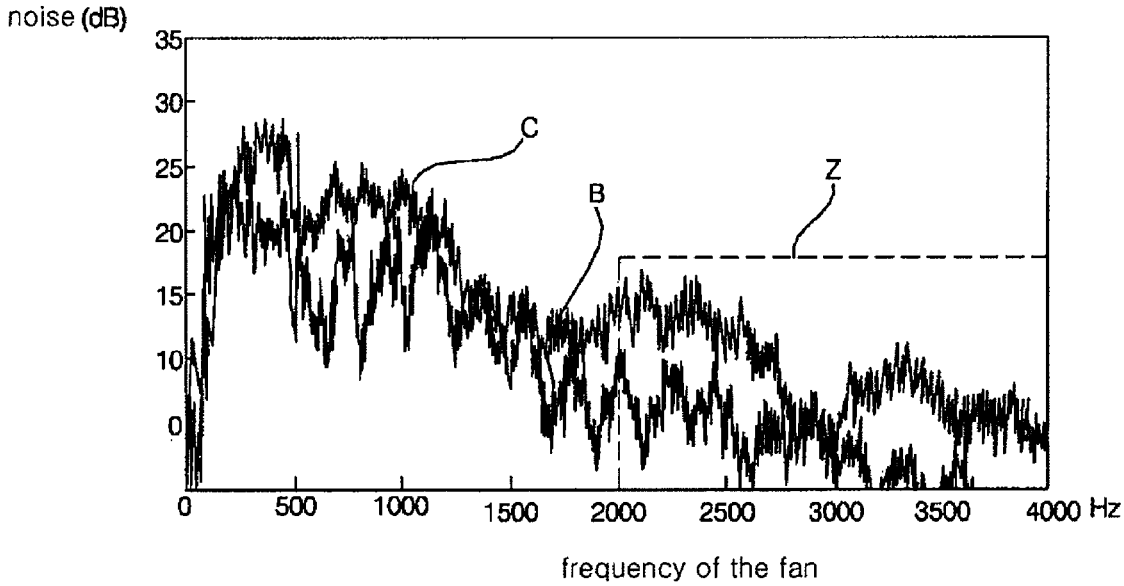
FIG. 5 is a graph showing an abnormal noise region of the fan shown in FIG. 1, comparing the embodiment with a comparative example.

FIG. 5 is a graph showing an abnormal noise region of the fan according to the invention, comparing this embodiment with a comparative example which will be described below with reference to FIG. 6. Specifically, FIG. 5 shows an abnormal noise region caused by the fan, which is measured when the fan has a diameter of 460 mm and the radius of curvature at the boundary point 18C of the curved boundary portion 10 is 10 mm. The radius of curvature is a reciprocal number of curvature, and millimeter (mm) is used as a unit thereof.

Abnormal noise which jars on the ears does not have an effect upon average noise. However, the abnormal noise exists on a spectrum where the frequency of the fan ranges from about 2 kHz to 5 kHz. A Z region of FIG. 5 means the abnormal noise region. When the fan according to the invention is operated (B), an average value of signals in the abnormal noise region Z is reduced as much as about 3 dB, compared with when a fan according to the comparative example is operated (A).

Figure 6:
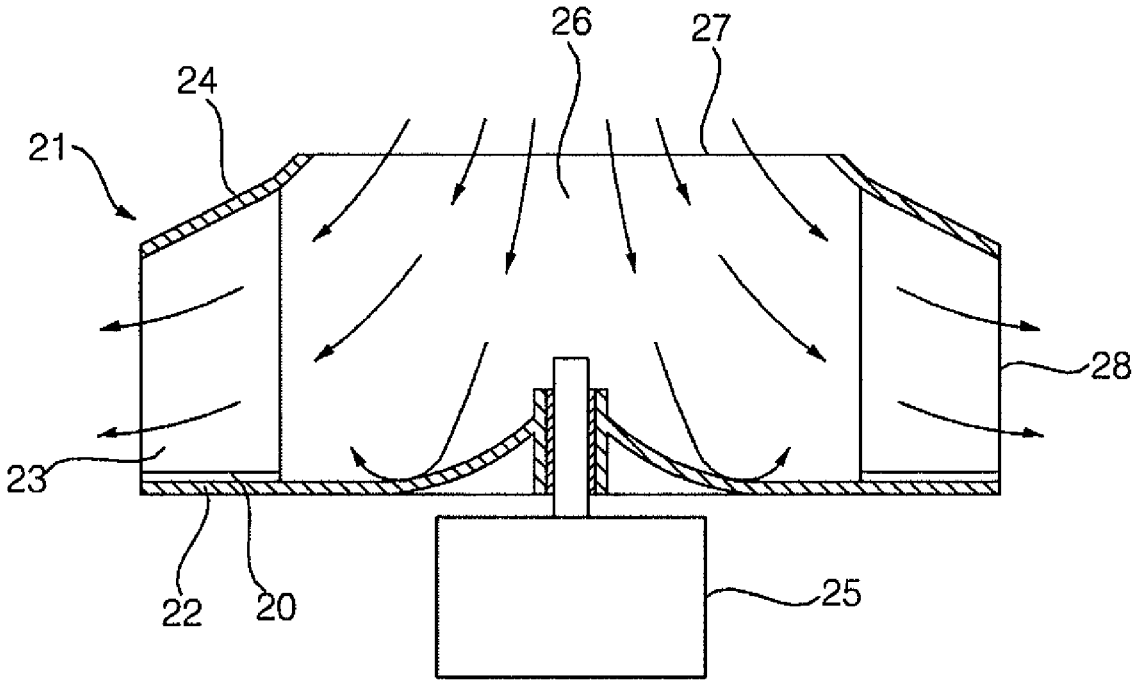
FIG. 6 is a partially-expanded side cross-sectional view of a fan according to the comparative example.

FIG. 6 is a partially-expanded side cross-sectional view of a fan according to the comparative example.

As shown in FIG. 6, the fan according to the comparative example includes a main body 21, a main plate 22 having a motor 25 installed therein, a plurality of blades 23 formed at a distance around the inner surface of the main plate 22, and a cover 4 connected along the upper ends of the blades 23. In the fan according to the comparative example, air is drawn through an inlet 27 formed at the upper portion of the main body 21, in order to draw air from an axial direction of the fan. The drawn air passes through a flow path 26 formed in the central portion of the fan and is then discharged through an outlet 28 formed at a side surface of the fan. The curvature of a boundary line 28 between the main plate 22 and the blade 23 is 0 or constant. In such a fan according to the comparative example, while air drawn through the inlet 27 by the operation of the fan is provided to an indoor room through the outlet 28, a dead zone where air does not smoothly flow and is congested can occur inside the blade 23. Therefore, the air flow cannot be naturally changed, thereby generating abnormal noise. Further, since the curvature of the boundary line 20 is constant at the outer end portion of the blade 23, a flow is not smoothly discharged, and a vortex occurs, thereby generating abnormal noise.

While the present invention has been described with reference to exemplary embodiments thereof, it will be understood by those skilled in the art that various changes and modifications in form and detail may be made therein without departing from the scope of the present invention as defined by the following claims. For example, although a ceiling-type air conditioner is exemplified in this embodiment, the turbo fan according to the invention can be applied to a combination air conditioner or separation-type air conditioner as well as the ceiling-type air conditioner.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

Although the invention has been described with reference to several exemplary embodiments, it is understood that the words that have been used are words of description and illustration, rather than words of limitation. As the present invention may be embodied in several forms without departing from the spirit or essential characteristics thereof, it should also be understood that the above-described embodiments are not limited by any of the details of the foregoing description, unless otherwise specified. Rather, the above-described embodiments should be construed broadly within the spirit and scope of the present invention as defined in the appended claims. Therefore, changes may be made within the metes and bounds of the appended claims, as presently stated and as amended, without departing from the scope and spirit of the invention in its aspects.

What is claimed is:

1. A fan comprising:

a main plate;

at least one or more blades connected to the main plate; and at least a portion of a boundary portion between the main plate and a pressure surface of the blade that includes a curved boundary portion such that the blade and the main plate are connected to each other at a curvature, wherein the curved boundary portion has a curvature of which at least a portion changes along a flow direction, a boundary line of the curved boundary portion at the main plate is nearly vertical with respect to an axial direction of the fan, and a boundary line of the curved boundary portion at the blade is varied in accordance with a curvature change with respect to the axial direction of the fan.

2. The fan according to claim 1, wherein the curved boundary portion is positioned at an upstream portion of the boundary portion in a flow direction.

3. The fan according to claim 1, wherein the boundary line of the curved boundary portion at the blade has an inflected portion formed in a curved line.

4. The fan according to claim 1, wherein between the upstream point and the downstream point of the curved boundary portion, at least the curvature of the downstream point is substantially 0.

5. A fan comprising:

a main plate;

at least one or more blades connected to the main plate; and at least a portion of a boundary portion between the main plate and a pressure surface of the blade that includes a curved boundary portion such that the blade and the main plate are connected to each other at a curvature, wherein the curvature of the curved boundary portion increases and then decreases along a flow direction.

6. The fan according to claim 5, wherein a boundary line of the curved boundary portion at the main plate is nearly vertical with respect to an axial direction of the fan, and a boundary line of the curved boundary portion at the blade comprises a boundary-rising portion which is tilted toward the blade with respect to the axial direction of the fan and a boundary-dropping portion which is tilted toward the main plate with respect to the axial direction.

7. The fan according to claim 6, wherein in the curved boundary portion, a boundary portion between the boundary-rising portion and the boundary-dropping portion is formed in a curved line.

8. The fan according to claim 5, wherein between the upstream point and the downstream point of the curved boundary portion, at least the curvature of the downstream point is substantially 0.

9. A fan comprising:

a main plate;

at least one or more blades connected to the main plate;

a boundary portion between the main plate and a pressure surface of the blade is configured such that the blade and the main plate are connected to each other at a curvature; and a boundary line of the boundary portion at the blade comprises a boundary-rising portion, which is tilted toward the blade with respect to an axial direction of the fan along a flow direction, and a boundary-dropping portion which extends from the boundary-rising portion and is tilted toward the main plate with respect to the axial direction along the flow direction.

10. The fan according to claim 9, wherein the boundary portion has the maximum curvature at a boundary point between the boundary-rising portion and the boundary-dropping portion.

11. The fan according to claim 9, wherein the curvature of the boundary-rising portion gradually increases along the flow direction.

12. The fan according to claim 9, wherein the curvature of the boundary-dropping portion gradually decreases along the flow direction.

13. The fan according to claim 9, wherein between the upstream point and the downstream point of the boundary portion, at least the curvature of the end point is substantially 0 along the flow direction.

14. The fan according to claim 9, wherein when the upstream point of the boundary portion is 0 and the downstream point of the boundary portion is 1 along the flow direction, a boundary point between the boundary-rising portion and the boundary-dropping portion is larger than 0 and is smaller than 0.5.

15. The fan according to claim 9, further comprising:

a cover having a suction portion into which air is drawn; wherein the main plate is spaced from the cover along an axial direction.

16. The fan according to claim 15, wherein between an upstream point and a downstream point of the curved boundary portion, at least the curvature of the downstream point is substantially 0 along the flow direction.

17. A fan comprising:

a cover having a suction portion into which air is drawn;

a main plate spaced from the cover along an axial direction;

a plurality of blades provided between the cover and the main plate in a radial configuration such that air can be centrifugally discharged through the suction portion along an axis; and at least a portion of a boundary portion between the main plate and a pressure surface of each blade provided as a curved boundary portion such that the blade and the main plate are connected to each other at a curvature, wherein between an upstream point and a downstream point of the curved boundary portion, at least the curvature of the downstream point is substantially 0 along a flow direction.

* * * * *